US005451282A

United States Patent [19]

Fore

[11] Patent Number: 5,451,282

[45] Date of Patent: Sep. 19, 1995

[54] METHOD FOR PROTECTING LUGGAGE

[76] Inventor: John C. Fore, 33203 Highway 1019, Denham Springs, La. 70726

[21] Appl. No.: 185,523

[22] Filed: Jan. 24, 1994

[51] Int. Cl.[6] ..... B32B 31/00

[52] U.S. Cl. ..... 156/212; 53/414; 53/419; 100/2; 100/33 PB; 156/91; 156/306.3; 190/101; 190/120

[58] Field of Search ..... 156/212, 306.3, 91; 190/101, 120; 100/2, 33 PB; 53/414, 419

[56] References Cited

U.S. PATENT DOCUMENTS 3,955,656 5/1976 Kashinski ..... 190/120

4,065,343 12/1977 Stumpe ..... 156/212

*Primary Examiner*—John J. Gallagher

*Attorney, Agent, or Firm*—Reginald F. Roberts, Jr.

[57] ABSTRACT

A method for protecting luggage in transit. A strip is made of a material which adheres to itself but not to the luggage or to a lock for the luggage. The strip is wrapped around the luggage and the lock, and the ends of the strip are pressed together, causing them to stick to one another and seal the luggage and the lock. If further protection is desired, a strand of wire, rope, cord, string, or the like is tied over the strip used to seal the luggage and lock, and a second strip of the same material wrapped over and around the strand, the first strip, the luggage, and the lock, and used to further seal the luggage and the lock by pressing the ends of the second strip against one another.

5 Claims, 3 Drawing Sheets

METHOD FOR PROTECTING LUGGAGE

BACKGROUND OF THE INVENTION

The present invention relates to luggage. More particularly, the invention relates to the protection of luggage during shipment or transport by air, sea, or land; by aircraft, ship, bus, truck, or rail.

It is a common occurrence to have luggage tampered with during such shipment, and even to have such tampering result in theft of some of the contents of the luggage. Often the items stolen are valuable. They may not be insured; of if insured, they may be irreplaceable, or be worth more than the insurer is willing or required to pay the insuree.

The present invention provides a solution to the above problems.

SUMMARY OF THE INVENTION

In general, the present invention provides two methods for protecting luggage having a lock. Both methods utilize a strip of an inelastic plastic tape of uniform composition and structure, having the property over its entire length of adhering to itself but not to other surfaces. The second method utilizes a strong, flexible strand, and first and second strips of an inelastic plastic tape of uniform composition and structure, having the property over its entire length of adhering to itself but not to other surfaces. The first strip, the second strip, and the flexible strand all have first and second ends.

According to the first method, the strip is wrapped around the luggage and the lock, and the first and second ends of the strip are pressed together, thereby causing the ends of the strip to adhere to one another and to seal the lock and the luggage.

According to the second method, the first strip is wrapped around the luggage and the lock, and the first and second ends of the first strip are pressed together, thereby causing the ends of the first strip to adhere to one another and to seal the lock and the luggage. The flexible strand is then wrapped over the first strip, and around the luggage and the lock; and the first and second ends of the strand are connected to one another, thereby further sealing the lock and the luggage. The second strip is then wrapped over the first strip and the flexible strand, and around the luggage and the lock; and the first and second ends of the second strip are pressed together, thereby causing the ends of the second strip to adhere to one another and to further seal the lock and the luggage.

DETAILED DESCRIPTION OF THE INVENTION

Figure 1:
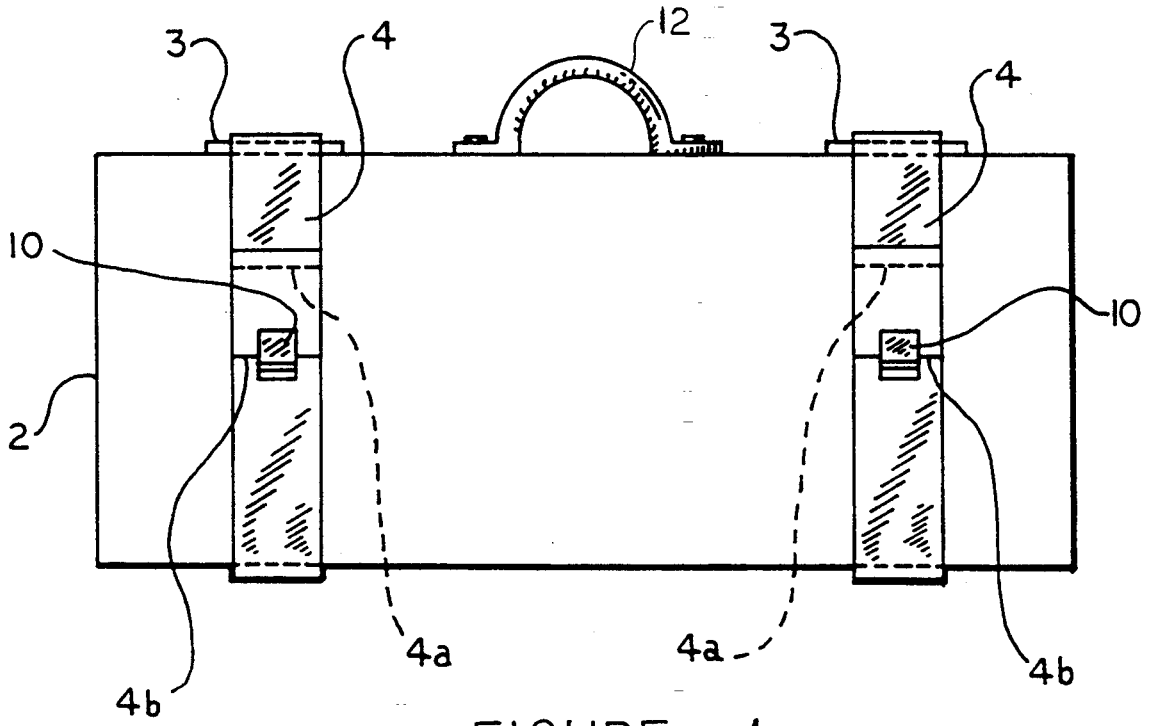
FIG. 1 is a side elevation of a first method for protecting luggage in accordance with the principles of the present invention.
Figure 2:
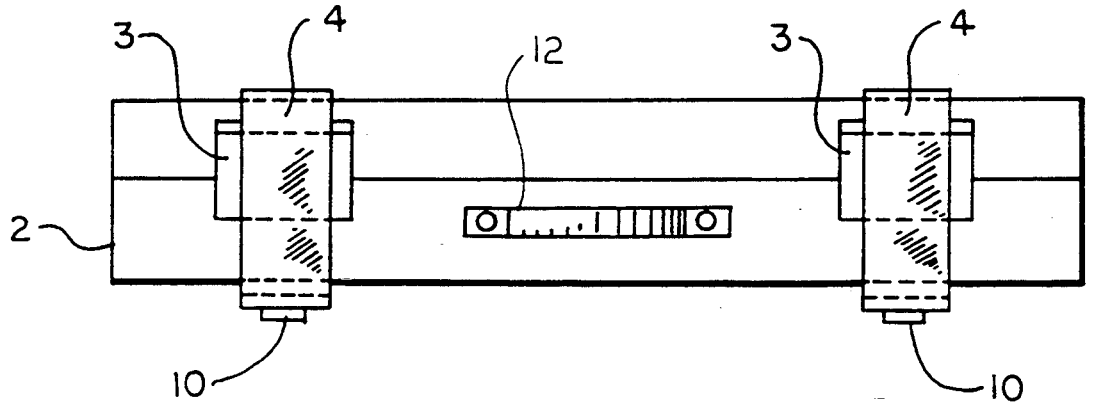
FIG. 2 is a top plan view of the method shown in FIG. 1.
Figure 3:
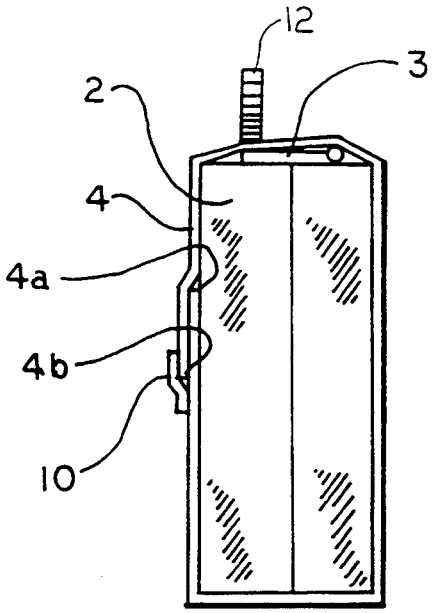
FIG. 3 is an end view of the method shown in FIG. 1.

More specifically, reference is made to FIGS. 1–3, in which is illustrated a first method for protecting luggage in accordance with the principles of the present invention.

A piece of luggage 2 is provided with a lock 3. In preparing to ship the luggage 2, the lock 3 is locked after the luggage 2 has been packed as desired.

A strip 4 of a particular material is wrapped around the luggage 2 and lock 3. The material of which the strip 4 is made has the property of adhering to itself but not to the luggage 2 or lock 3.

The strip 4 has first and second ends 4*a* and 4*b*, respectively. To seal the lock 3 and the luggage 2, the first and second ends 4*a* and 4*b* of the strip 4 are pressed together, causing them to adhere to one another.

Figure 4:
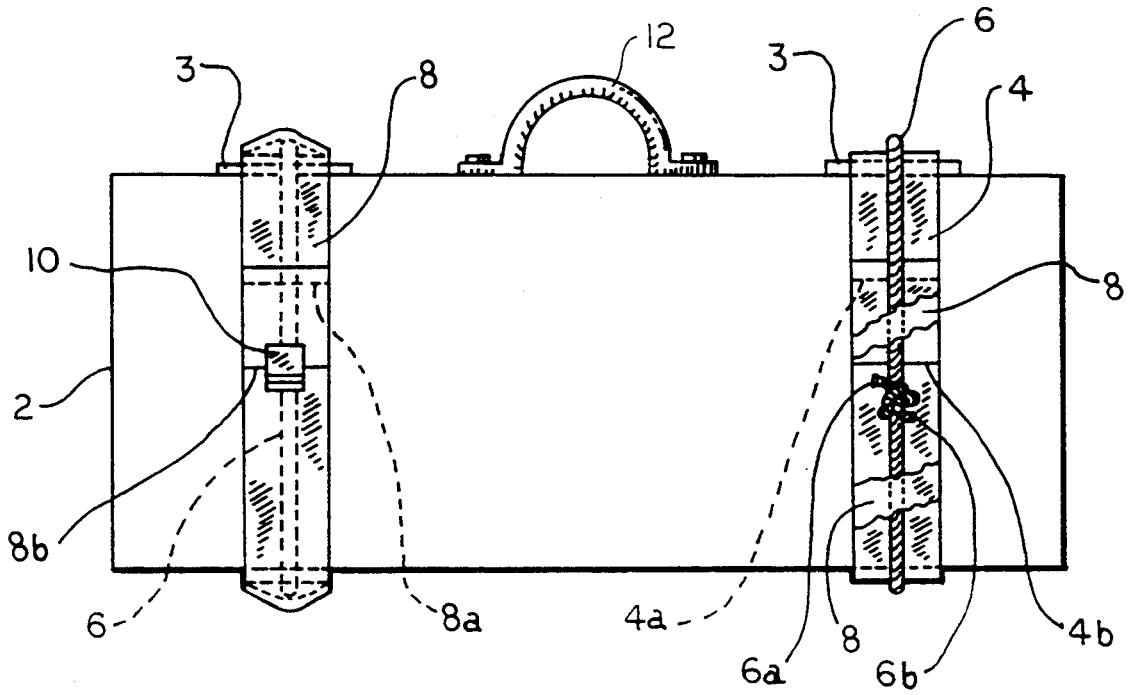
FIG. 4 is a side elevation of a second method for protecting luggage in accordance with the principles of the present invention.
Figure 5:
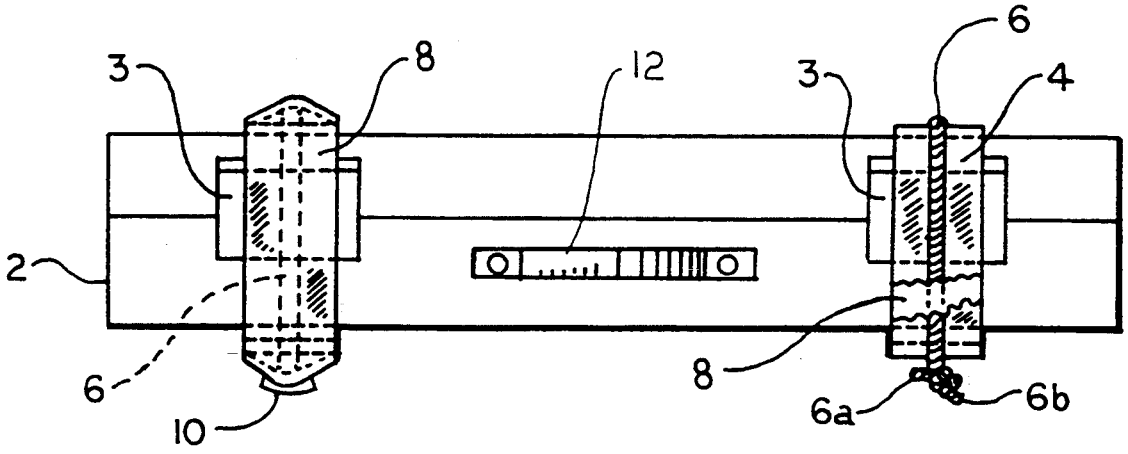
FIG. 5 is a top view of the method illustrated in FIG. 4.
Figure 6:
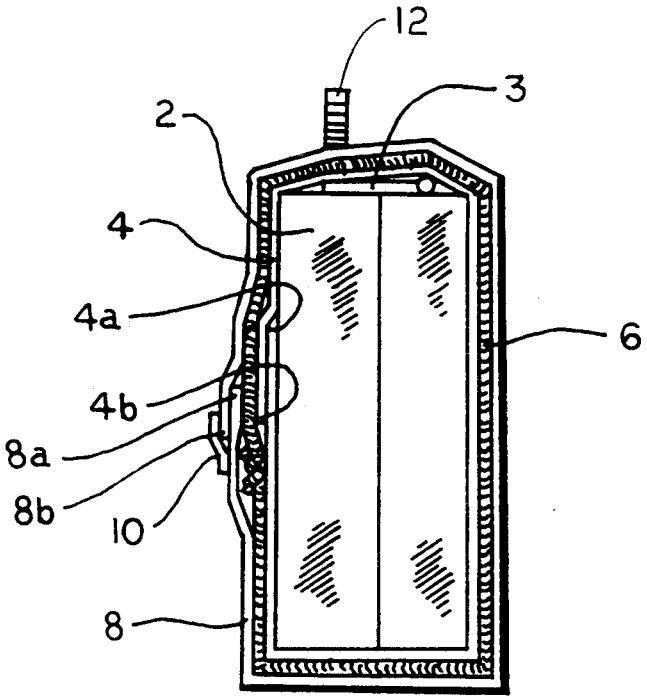
FIG. 6 is an end view of the method illustrated in FIG. 4.

Reference is now made to FIGS. 4–6, in which is illustrated a second method for protecting luggage in accordance with the principles of the present invention.

After the preliminary operations described above for preparing the luggage for shipment have been completed, a first strip 4 of the same material described above, having first and second ends 4*a* and 4*b*, is wrapped around the luggage 2 and lock 3, and the first and second ends 4*a* and 4*b* are pressed together to seal the luggage 2 and lock 3. A strand 6 of wire, rope, cord, string, or the like is then wrapped over the first strip 4, and around the luggage 2 and lock 3. The strand 6 has first and second ends 6*a* and 6*b*, and the ends 6*a* and 6*b* are connected or tied to one another, thereby further sealing the luggage 2 and lock 3. Finally, a second strip 8 made of the same material as the first strip 4 and having first and second ends 8*a* and 8*b*, is wrapped over the strand 6 and first strip 4, and around the luggage 2 and lock 3, and the ends 8*a* and 8*b* are pressed together, causing them to adhere to one another and to further seal the luggage 2 and lock 3.

An inelastic plastic tape of uniform composition and structure, having the property over its entire length of adhering to itself but not to other surfaces is marketed as ALMOST TAPE and SQUEEZE IT, registered trademarks of Nifty Products, Old Bridge, N.J. 08867.

A label 10 is beneficially attached to the top surface of the first strip 4 (FIGS. 1–3) or second strip 8 (FIG. 4–6) to identify the luggage 2, and to further seal the luggage 2 and lock 3.

As shown in FIGS. 1–6, the luggage 2 may be and often is provided with a pair of locks 3. Furthermore, the luggage 2 is usually and beneficially provided with a handle 12.

I claim:

1. A method for protecting luggage having a lock, the method comprising the steps of:

(a) providing a strip having first and second ends of an inelastic plastic tape of uniform composition and structure, having the property over its entire length of adhering to itself but not to other surfaces;

(b) wrapping the strip around the luggage and the lock; and (c) pressing the first and second ends of the strip together, thereby causing the first and second ends of the strip to adhere to one another and to seal the lock and the luggage.

2. The method of claim 1, further comprising the step of:

(d) attaching a label to the strip.

3. A method for protecting luggage having a lock, the method comprising the steps of:

(a) providing a strip having first and second ends of an inelastic tape of uniform composition and structure, having the property over its entire length of adhering to itself but not to other surfaces;

(b) wrapping the strip around the luggage and the lock; and (c) pressing the first and second ends of the strip together, thereby causing the first and second ends of the strip to adhere to one another and to seal the lock and the luggage.

4. A method for protecting luggage having a lock, the method comprising the steps of:

(a) providing a strong, flexible strand having first and second ends;

(b) providing a first strip of a material which adheres to itself but not to the luggage or to the lock, the first strip having first and second ends;

(c) providing a second strip of a material which adheres to itself but not to the luggage or to the lock, the second strip having first and second ends;

(d) wrapping the first strip around the luggage and the lock;

(e) pressing the first and second ends of the first strip together, thereby causing the first and second ends of the first strip to adhere to one another, and to seal the lock and the luggage;

(f) wrapping the flexible strand over the first strip, and around the luggage and the lock;

(g) joining the first and second ends of the strand to one another, thereby further sealing the lock and the luggage;

(h) wrapping the second strip over the first strip and the flexible strand, and around the luggage and the lock; and (i) pressing the first and second ends of the second strip together, thereby causing the first and second ends of the second strip to adhere to one another and to further seal the lock and the luggage.

5. The method of claim 4, wherein the first and second strips are strips of an inelastic plastic tape of uniform composition and structure, having the property over its entire length of adhering to itself but not to other surfaces.

* * * * *